United States Patent [19]

Török et al.

[11] Patent Number: 4,955,991

[45] Date of Patent: Sep. 11, 1990

[54] ARRANGEMENT FOR GENERATING AN ELECTRIC CORONA DISCHARGE IN AIR

[75] Inventors: Vilmos Török, Lidingö; Andrezej Loreth, Akersberga, both of Sweden

[73] Assignee: Astra-Vent AB, Stockholm, Sweden

[21] Appl. No.: 252,362

[22] PCT Filed: Apr. 13, 1987

[86] PCT No.: PCT/SE87/00183

§ 371 Date: Sep. 26, 1988

§ 102(e) Date: Sep. 26, 1988

[87] PCT Pub. No.: WO87/06501

PCT Pub. Date: Nov. 5, 1987

[30] Foreign Application Priority Data

Apr. 21, 1986 [SE] Sweden ..... 8601817

[51] Int. Cl.[5] ..... B03C 3/00

[52] U.S. Cl. ..... 55/120; 55/151; 55/152

[58] Field of Search ..... 55/2, 129, 138, 130, 55/150–152, 120; 361/230–232

[56] References Cited

U.S. PATENT DOCUMENTS

| | | | |
|---|---|---|---|
| 2,004,352 | 6/1935 | Simon | 55/138 |
| 3,184,901 | 5/1965 | Main | 55/138 |
| 4,339,782 | 7/1982 | Yu et al. | 55/131 |
| 4,435,190 | 3/1984 | Taillet et al. | 361/230 |

*Primary Examiner*—Bernard Nozick

*Attorney, Agent, or Firm*—Browdy and Neimark

[57] ABSTRACT

An arrangement for generating an electric corona discharge in air having a corona electrode, a target electrode which is spaced from the corona electrode, and a d.c. voltage source, the respective terminals of which are connected to the corona electrode and the target electrode. The voltage of the voltage source and the construction of the corona electrode are such as to generate a corona discharge at the corona electrode. A conduit is provided for continuously removing the air present in the immediate vicinity of the corona electrode and dealing with the air thus removed in a manner to render innocuous physiologically harmful substances or irritants present in the air and generated by the corona discharge, such as primarily ozone and nitrogen oxides.

3 Claims, 1 Drawing Sheet

ARRANGEMENT FOR GENERATING AN ELECTRIC CORONA DISCHARGE IN AIR

The present invention relates to an arrangement for generating an electric corona discharge in air, comprising a corona electrode, a target electrode located at a distance from the corona electrode, and a d.c. voltage source, the two terminals of which are connected to the corona electrode and the target electrode respectively, the voltage between the two terminals of the voltage source and the construction of the corona electrode being such as to generate a corona discharge at the corona electrode.

Corona discharge arrangements of this kind are used to a significant extent in, e.g., electrofilters intended for air purification purposes, in which filters the air ions generated through the corona discharge are utilized to charge electrically the particulate contaminants and/or liquid droplets present in the air. The electrically charged particles/droplets are attracted to and fasten on collecting surfaces which have an opposite polarity to the charged particles or droplets, thus being extracted from the air. The polarity obtained by the particles or droplets is the same polarity as that obtained by the air ions, the polarity of which ions is dependent, in turn, on the polarity of the corona electrode. Electrofilters of this kind are known in many different structural forms. Such corona discharge arrangements may also be used in air transportation systems of the kind which utilize so-called electric ion-winds or corona-winds. Such air transportation systems are found described in, for example, U.S. Pat. No. 4,812,711.

One serious problem encountered with the use of corona discharge generators in localities where people are to be found, such as in domestic dwellings or places of work for instance, and also in ventilation systems or air processing systems which are connected to such localities, is that the corona discharge generates chemical compounds, primarily ozone and nitrogen oxides, which if present in excessively high concentrations can be experienced as irritative, and may also be harmful to the health. The generation of these irritants in conjunction with a corona discharge occurs at a rate which is contingent on the magnitude of the electric corona current, and is much greater in the case of a negative corona discharge than in the case of a positive corona discharge. Consequently, a positive corona discharge has been used practically always when employing such systems and apparatus in human environments However, the aforesaid irritants are still generated even when employing a positive corona discharge, and the problem thus still remains Consequently, it is necessary to limit the corona current in relation to the quantity of air that passes the corona discharge arrangement per unit of time, so that the proportion of irritants present in this quantity of air is restricted to acceptable values. In particular the corona current must be limited quite radically when the arrangement used is one in which the same air passes by the corona discharge arrangement a number of times and therewith results in a successive accumulation of irritants in the air. In the case of electrofilters this necessary radical limitation of the corona current results in a filter of low efficiency and also in filters of large dimensions, while in the case of air transportation systems which operate with ion winds, it is extremely difficult to transport air in quantities which are sufficiently large from a practical point of view The use of pointed or needle-like corona electrodes has been practically excluded by the necessity of working with a positive discharge, despite the fact that such electrodes are beneficial both from an electrotechnical and a mechanical aspect. This is because when using needle-like or pointed corona electrodes and creating a positive corona discharge, so-called streamers, i.e. long thread-like corona discharge channels, readily form in the ambient air, these streamers resulting in an unstable corona discharge and in an increase in the generation of irritants.

Consequently, the object of the present invention is to provide a corona discharge arrangement of the kind described in the introduction with which the problem created by the aforedescribed irritants produced in conjunction with the corona discharge can be eliminated, or at least greatly reduced.

This object is achieved in accordance with the invention by constructing the corona discharge generating arrangement in accordance with the accompanying claims.

The invention is based on the discovery that it is possible to recover the predominant part of the irritants generated in conjunction with a corona discharge and to render these recovered irritants innocuous, by removing continuously the air present in the immediate vicinity of the corona electrode and dealing with the thus removed air in a manner which will render harmless the irritants present in said air and generated by the corona discharge. This can be effected, for example, by passing the air removed from the immediate vicinity of the corona electrode to a location at which the irritants are no longer offensive, e.g. to the outdoor atmosphere, or by cleansing said removed air of the irritants present therein with the aid of suitable sorbents effective in extracting the irritants from said air. It has been found that only relatively small amounts of air need be removed from the immediate vicinity of the corona electrode, since the irritants are formed in the so-called corona layer on the electrically active part of the corona electrode. This removal can be effected without appreciably disturbing the desired air flow past the corona electrode and without needing to disturb in any way the desired generation of air ions and the movement of these ions towards the target electrode.

The invention will now be described in more detail with reference to the accompanying drawings, which illustrate a number of exemplifying embodiments of an arrangement according to the invention and in which FIG. 1 illustrates schematically a first embodiment of an arrangement according to the invention;

Figure 1:
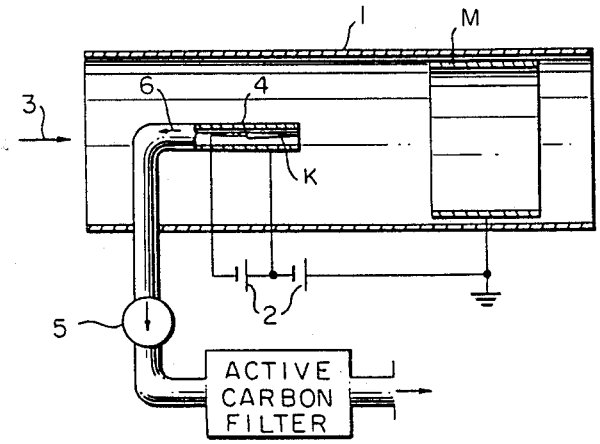

FIG. 1 illustrates schematically and in axial section an arrangement for transporting air with the aid of a so-called electric ion-wind. The arrangement includes an air flow channel or duct 1, in which a corona discharge arrangement is located. The corona discharge arrangement comprises a pointed or needle-like corona electrode K which extends axially within the duct 1, and a target electrode M in the form of a cylindrical surface spaced axially from and located downstream of the corona electrode K. The target electrode M and the corona electrode K are each connected to a respective terminal of a d.c. voltage source 2, the voltage of which is such as to generate a corona discharge at the corona electrode K. The air ions generated by this corona discharge migrate to the target electrode at high speed, colliding with and transferring kinetic energy to the surrounding air molecules during their journey, so as to produce an air flow through the duct 1 in the direction indicated by the arrow 3. The mechanism by which air is transported in this way with the aid of an electric ion-wind is described in detail in the aforementioned International Patent Application.

Figure 4:
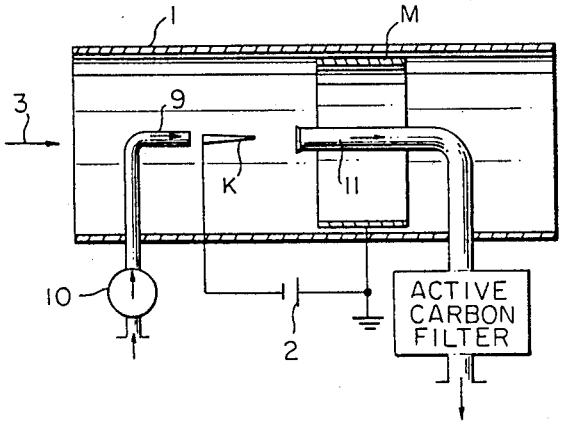
FIG. 4 illustrates schematically a fourth embodiment of an arrangement according to the invention.

As mentioned in the aforegoing, the generation of a corona discharge at the corona electrode results in the production of chemical substances, primarily ozone and nitrogen oxides, which may have an irritating effect, and even a harmful effect, on people present. A particularly large quantity of such irritants is produced when the corona electrode K is connected to the negative terminal of the voltage source 2, as in the embodiment illustrated in FIG. 1, such as to produce a negative corona discharge. The quantity of irritants thus produced increases with increasing values of the corona current. A high corona current is desirable, however, in order to transport a large quantity of air through the duct 1. In the FIG. 1 embodiment of the inventive arrangement, the predominant part of these irritants generated at the corona electrode K is removed, by placing the corona electrode within a narrow tube 4 which surrounds the corona electrode K co-axially therewith and which presents in a direction towards the target electrode M an open end which is located approximately on the same level as the point of the corona electrode K. This tube 4 is connected.-d to a fan, air pump or some corresponding device 5 effective in maintaining a flow of air through the tube in the direction of arrow 6. The air located in the immediate vicinity of the corona electrode is hereby removed continuously, and therewith also the predominant proportion of those irritants that form as a result of the corona discharge on the corona electrode. The irritant-containing air removed through the tube, e.g. by suction, can be released to the outdoor atmosphere, where the irritants will have no deleterious effect, or can be passed to a cleansing purifying device in which the irritants are removed from the air with the aid of some suitable absorbent material, such as active carbon for example, as shown in FIGS. 1 and 4. For example, it has been found that in the case of a corona current of 20 $\mu$A from a point, the predominant part of the irritants generated can be removed with a rate of air flow within the tube 4 of from 1 to 2 m/s. The tube 4 embracing the corona electrode K can therewith be given a diameter of, for example, 5–10 mm. It has also been found that this continuous removal by suction of the air located in the immediate vicinity of the corona electrode K has no appreciable disturbing influence on the air flow 3 through the duct 1. Neither is there any disturbing effect on the corona discharge, and therewith on the generation of ions, or on the movement of the ions towards the target electrode M, when the point of the needle-like electrode K is located flush with the plane of the orifice or opening of the tube 4 in the illustrated manner. At least that part of the tube 4 which is located nearest the corona electrode K may also comprise an electrically conductive or semi-conductive material and be connected to a potential close to the potential of the corona electrode K, in the manner illustrated in FIG. 1. The tube 4 will, in this way, function as an excitation electrode for the corona discharge, which takes up solely a small part of the total corona current. This will eliminate the risk of the tube 4 having a screening influence on the corona electrode K, which could otherwise disturb the corona discharge.

Because the inventive arrangement enables the predominant part of the irritants generated by the corona discharge to be removed and rendered innocuous, an arrangement that is constructed in accordance with the invention can be used without detriment in peopled environments. In addition hereto, the arrangement also enables the use of a negative corona discharge, thereby facilitating the use of a pointed or needle-like corona electrode, which affords benefits in other connections. It has been found that removal by suction of air located around the pointed corona electrode K through the tube 4 also prevents the formation of so-called streamers when the corona electrode is positive, and hence it would seem that the invention enables the use of a pointed or needle-like corona electrode together with a positive corona discharge. Furthermore, it is also possible to use a larger corona current, which in turn results in a greater flow of air through the duct 1 and improved electrical charging of the aerosols in the air, thereby enabling these aerosols to be extracted more readily.

Figure 2:
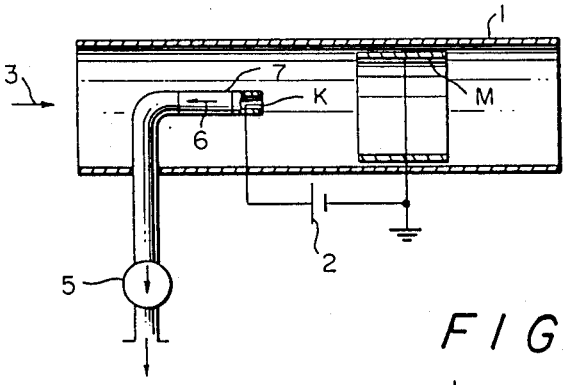
FIG. 2 illustrates schematically a second embodiment of an arrangement according to the invention.
Figure 2A:
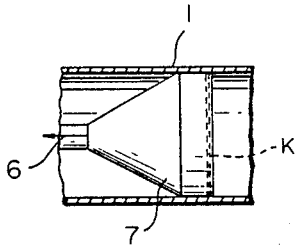
FIG. 2A is a schematic side view of the upper portion of conduit 7 in duct 1 of FIG. 2.

FIG. 2 illustrates schematically and in section a similar arrangement for transporting air through an air flow channel or duct 1, in the direction of the arrow 3. The duct 1 of this embodiment is of elongated rectangular cross-section and the corona electrode K comprises a wire which extends perpendicular to the plane of the drawing along the long centre axis in the rectangular cross-section of the duct 1. The target electrode M of this embodiment comprises two surfaces which extend parallel with the side walls of the duct 1 and also with the wire-like corona electrode K. The suction means for removing continuously air located in the immediate vicinity of the corona electrode K comprises in this case a conduit 7 with a narrow elongated rectangular cross-section and an orifice which faces the target electrode M and in which the wire-like corona electrode K is located centrally, approximately flush with or slightly inwardly of the plane of the orifice. As with the tube of the former embodiment, the conduit 7 is also connected to a fan, pump or corresponding device 5 effective to maintain a flow of air through the conduit 7, in the direction of the arrow 6. FIG. 2A is a schematic side view of the duct 1, the suction conduit 7, and the corona wire K located in the proximity of the conduit orifice.

Figure 3:
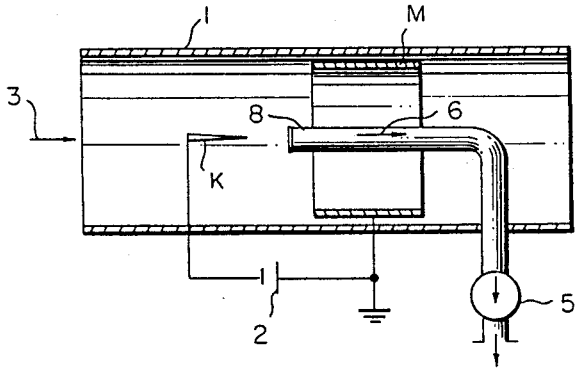
FIG. 3 illustrates schematically a third embodiment of an arrangement according to the invention.

FIG. 3 illustrates schematically and in section an air transporting arrangement similar to that illustrated in FIG. 1 and described in the aforegoing In this case, however, the air present in the immediate vicinity of the corona electrode K is removed continuously from the system with the aid of a conduit which is located downstream of the corona electrode K with the tube orifice facing said electrode. The conduit 8 is connected to a fan, air pump, or some equivalent device 5 similar to the aforedescribed embodiments, so that air can be withdrawn through the conduit 8 by suction. However, if the rate of air flow through the duct 1 is sufficiently high and substantially laminar, the provision of a separate fan, pump or like suction device may conceivably be dispensed with. This is thought to apply particularly in the case of electrofilters with which a relatively powerful air flow is generated in the duct 1 through the use of an external fan or like device. It must be ensured in the arrangement according to FIG. 3 that the air suction conduit 8 does not obstruct the view from the corona electrode K to the target electrode M and therewith prevent the desired migration of ions from the corona electrode K to the target electrode M.

The arrangement illustrated schematically and in section in FIG. 4 is in principle the same as that illustrated in FIG. 3. With the arrangement of FIG. 4, however, the air located in the immediate vicinity of the corona electrode K is removed still more effectively, by directing a relatively powerful and concentrated jet of air along the corona electrode K with the aid of a nozzle 9 located upstream of the corona electrode and supplied from a fan, air pump or corresponding device 10. The air jet passing the corona electrode in the manner just described entrains the irritants generated in conjunction with the corona discharge and is captured in and carried away by a conduit 11 located downstream of the corona electrode K, the open inlet orifice of said conduit facing said electrode. If desired, the conduit 11 can also be connected to a fan, air pump, or some corresponding device which supports the desired air flow through the conduit 11.

It will be seen from the aforegoing that an arrangement constructed in accordance with the invention for removing continuously the air present in the immediate vicinity of the corona electrode such as to enable the irritant-containing air to be dealt with in a suitable manner, may be formed in various ways depending upon the construction of the corona discharge arrangement used. Although the invention has been described in the aforegoing with reference to air transporting systems which operate with an ion-wind, it will be understood that the invention, while affording the same advantages, can be used also with corona discharge arrangements which are not intended to produce an air-transporting ion-wind but are incorporated in, e.g., an electrofilter through which air is transported with the aid of a fan or corresponding device

We claim:

1. An arrangement for generating an electric corona discharge in an air flow path which is in communication with a human environment and continuously removing harmful gases produced as a consequence of the corona discharge from the air flow path comprising a duct having an air flow therethrough;

a corona electrode, and a target electrode spaced from said corona electrode in said air flow of said duct;

a d.c. voltage source having first and second terminals to which said corona electrode and said target electrode, respectively, are connected, the voltage between said terminals of said voltage source capable of creating a corona discharge at said corona electrode;

piping means to continuously remove harmful gases produced as consequence of said corona discharge, extending from inside said duct and out said duct, and having a first pipe with an orifice at one end of said first pipe;

said orifice of said first pipe located in the vicinity of and opening in the direction of said corona electrode, and said pipe over the remainder of its length being hermetically sealed relative to said air flow in said duct;

a second pipe having an open end located axially opposite to and spaced from said orifice of said first pipe;

air pumping means connected to said second pipe for generating a jet of air out through said open end of said second pipe closely past said corona electrode and into said orifice of said first pipe.

2. The arrangement as claimed in claim 1 wherein a purifying means for removing said harmful gases from a flow of air through said first pipe is connected to an other end of said first pipe.

3. The arrangement as claimed in claim 1 wherein said corona electrode comprises a short needle element oriented substantially axially in said air flow in said duct and said orifice is substantially circular.

* * * * *